United States Patent [19]

Jaffey

[11] 4,165,278

[45] Aug. 21, 1979

[54] SEPARATOR FOR SHREDDED MATERIALS

[76] Inventor: Irving Jaffey, 85 Estabrook, San Leandro, Calif. 94577

[21] Appl. No.: 839,372

[22] Filed: Oct. 4, 1977

[51] Int. Cl.[2] ..... B07B 13/00

[52] U.S. Cl. ..... 209/45

[58] Field of Search ..... 209/108, 45, 46, 133–137

[56] References Cited

U.S. PATENT DOCUMENTS

| | | | |
|---|---|---|---|
| 425,341 | 4/1890 | Piette | 209/45 X |
| 1,640,010 | 8/1927 | Schoenegg | 209/45 X |
| 1,913,876 | 6/1933 | Frederick | 209/45 X |
| 3,587,851 | 6/1971 | Anderson | 209/108 X |

FOREIGN PATENT DOCUMENTS

| | | | |
|---|---|---|---|
| 575785 | 5/1976 | Switzerland | 209/12 |

*Primary Examiner*—Ralph J. Hill

*Attorney, Agent, or Firm*—Warren J. Krauss

[57] ABSTRACT

Apparatus for automatically and selectively separating the components of an admixture of shredded materials in a scrap metal reclamation process according to the individual weights of such components. The apparatus includes conveying means for transmitting a shredded admixture of metals of various densities, lint, rubber, etc., to the periphery of a rotating drum. The periphery of the rotating drum is substantially completely perforate and is exposed from the interior thereof to a source of subatmospheric pressure. The rotating drum and a relatively fixed low pressure source interior thereof are so arranged that the differential between ambient pressure and the pressure at the drum perforations decreases as the drum rotates from a first point of material acquisition to a second point of deposition. This arrangement causes particulate components of the admixture to first become adherent to the perforations of the drum and then to drop free thereof, progressively, in accordance with the weight of each component, as the drum rotates. Additional conveying means are provided for collecting the various weight segregations of shredded materials, as they fall from the drum, for conveyance to different points of utilization.

19 Claims, 5 Drawing Figures

SEPARATOR FOR SHREDDED MATERIALS

BACKGROUND OF THE INVENTION

This invention relates to an apparatus for automatically segregating, by weight, the various components of an admixture of shredded metalic and non-metalic materials at the end of a shredding and reclamation process for discarded scrap, such as automobiles, refrigerators and the like. It also relates to an apparatus capable of directly mechanically separating out shredded components of a mixture, by weight, without recourse to expensive flotation systems, cyclone separators or the like. The apparatus utilizes pneumatic suction, selectively variable in degree, to attract admixture components to the surface of a rotating drum which, in turn, deposits such components, in accordance with the weight thereof, onto various conveyor belts for transmission to points of utilization.

A fast and economical approach to reclaiming nonferrous metals, in shredded form, from an admixture of lint, rubber, glass and other debris at the end of a scrap process has eluded industry for some time. The problem has been particularly vexing for small scale scrap operations without the finances or space for the elaborate and expensive separation systems now known to the art. Some of these systems include flotation chambers, causing scrap to pass through liquid pools of various specific gravities, trommels, hugh cyclone separators, bagging rooms, etc. In the past, most small operations either had to send their resultant scrap out for processing in gross, non-separated condition, or had to utilize a plurality of workers to separate out a substantial portion of the valuable nonferrous "red metals" such as cooper, brass and other materials, manually.

In the typical large volume auto scrap or solid waste management operation, the principal object is to recover valuable metals for recycling. Scrap in the form of automobiles, refrigerators, and other appliances are crushed and then fed to a shredding machine from whence a shredded admixture is conveyed to some form of air separator where a part of the light combustible materials may be burned off. Glass and certain other materials are removed by means of a trommel or shaker device. The resultant shredded admixture is composed of iron, steel, nonferrous metals, and mixed organic and inorganic wastes. This mixture is sent to a magnetic separator which removes the ferrous metals.

Most modern installations utilize a wet, or flotation separating system for removing the organic and inorganic waste such as rubber, plastic, fabric, fiber and dirt, from the admixture prior to the magnetic separation of ferrous from nonferrous metals. Such wet processing systems are typified by the WEMCO RC Separator, manufactured by the Envirotech Corporation of Sacramento, CA. "WEMCO" is a trademark of Envirotech Corporation. The alternative to wet processing of the admixture prior to separation of ferrous from nonferrous metals is the objectionable production of fumes, smoke, dust and odors generated by the friction and heat caused by dry shredding and separating.

The present invention, in one embodiment, is capable of efficiently and cleanly separating out the components of an admixture either prior to or subsequently to the removal of ferrous metals by magnetic means. The present system performs without an objectionable level of dust and odor production and without recourse to liquid current or flotation means. The present system operates by direct mechanical contact with the components of the scrap admixture and attracts out components thereof by weight through the simple expedient of air pressure.

The use of air suction systems of various types, per se, have been known in the agricultural industry for some time. For example, U.S. Pat. Nos. 2,783,888; 1,485,401; 3,961,397; and 3,815,178 to Dahlstrom et al.; McDonough, et al.; Neuenschwander; and Goldman, respectively, teach the use of suction in processing cotton, tobacco and the like. However, to this point, no one has applied the beneficial principles utilized in agricultural processing to large scale heavy-duty reclamation of metals and other heavy particulate from auto scrap and solid waste operations nor has the specific apparatus for applying such principles been devised.

The present invention engrosses the application of negative air pressure to rotary drum means and includes means for varying such air pressure for the purpose of automatically separating out and conveying metals having different weights or densities.

SUMMARY AND OBJECTS OF THE INVENTION

The instant shredded material separating apparatus comprises conveying means for conveying an admixture of shredded nonferrous materials to separating means for separating out components of the admixture, by weight. Perforate rotating drum means communicated internally with a source of low pressure air receive the admixture from the conveying means. Means are provided within the rotating drum means to vary the pressure to which given perforations are exposed as such perforations rotate angularly about a fixed axis. Means are provided for varying the internal pressure of the rotating drum en toto and also for varying the point of application of such pressure to the perforations of the rotating drum. The rotating drum means carries the admixture at the periphery thereof and deposits portions of it at various points, by weight, onto a plurality of conveying means for transmission to points of utilization. To achieve varying degrees of separation, a plurality of rotating drums are adopted to receive partially separated components of the original admixture for further separation. The apparatus may be actuated in a fully automatic mode by means of a suitable motor and control means by which the various parameters and operations thereof may be selectively regulated during processing. Blower means are provided for producing a negative pressure condition in the interior of the rotating drum means. The exhaust from such blower means may be used to drive turbine means which can activate additional blowers and conveying means in a series connected integrated system. Such exhaust can also be utilized to operate a cyclone separator if the present invention is utilized in concert with an existing system.

The primary object of the present invention is to provide an apparatus for automatically separating out components of a shredded admixture, by weight, without the utilization of liquid flotation or high velocity cyclone equipment.

Another object of the present invention is to provide an apparatus having means for the automatic high speed separation of nonferrous metals from organic and inorganic waste materials such as lint, rubber, etc.

A further object of the present invention is to provide an apparatus having a perforate rotating drum, rotatably mounted about a fixed inner drum with angularly variable pressure communicating port means for communicating subatmospheric air pressure to the peripheral perforations of the rotating drum.

A still further object of the invention is to provide a plurality of rotating drums and conveying systems for progressively processing an admixture of disparate shredded components for progressively isolating certain of said components to a purer concentration.

Another object of the invention is to provide a shredded material separating apparatus which is portable and can be readily installed and coordinated with existing solid waste and scrap separating operations to refine the end product of such operations cheaply, efficiently, and without manual labor.

Other objects and advantages of the present invention will become apparent from the following drawings and description.

DETAILED DESCRIPTION

With reference to the drawings, the preferred embodiments of the instant invention will now be presented. For the purpose of illustration only, the system will be described in an auto scrap materials context. However, it should be noted that the structural and operational principles of the present separating apparatus are equally applicable to the separation of constituents of solid waste in general.

Figure 1:
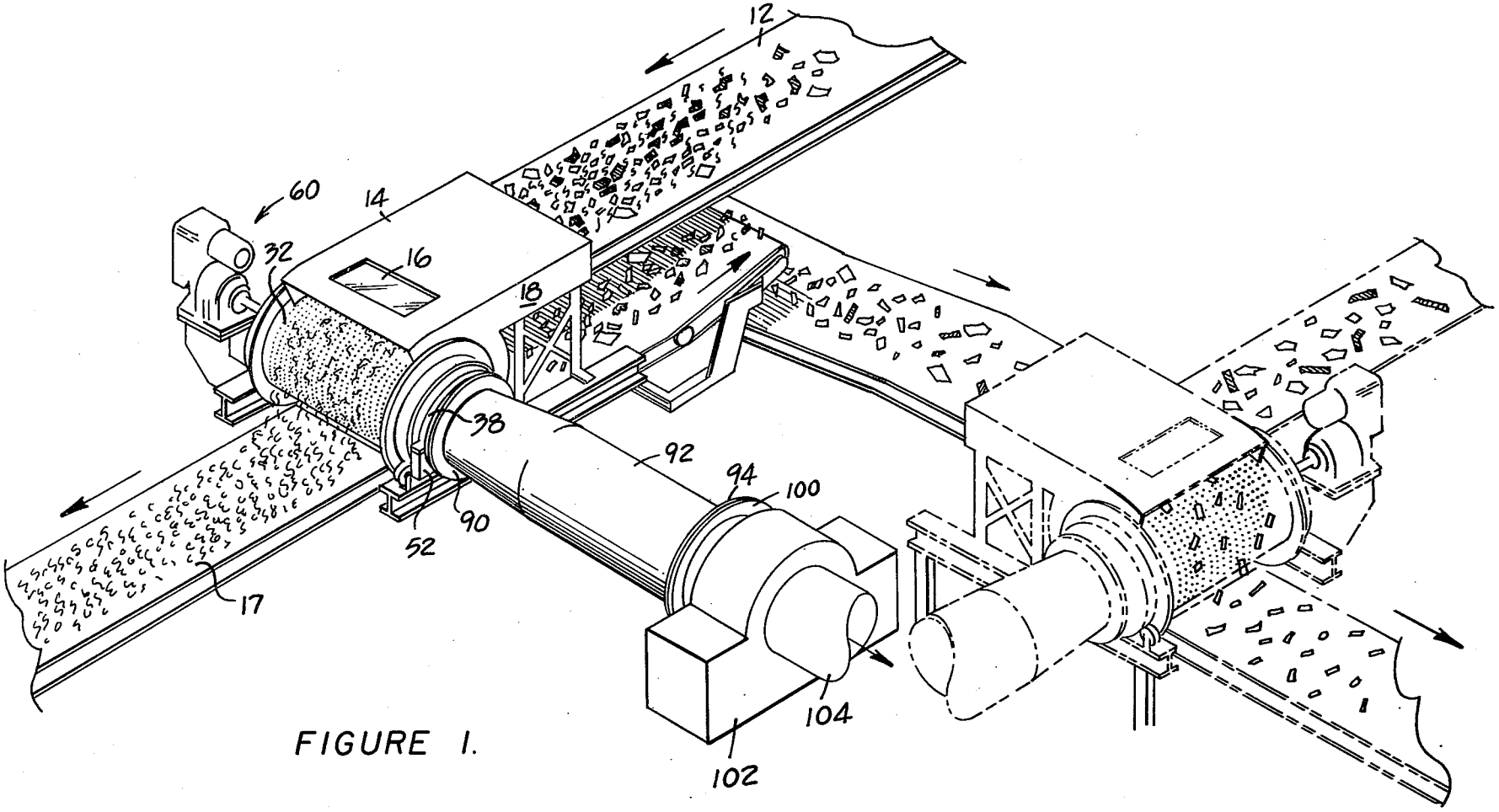
FIG. 1 is an isometric view of the present invention in operation including, in phantom, elements in plural for progressive refinement of the separation process.

In FIG. 1, a copious admixture of shredded materials such as lint, rubber, die cast aluminum, stainless steel, copper and brass, is carried by first conveying means, including a conveyor belt 12, to the separating means of the present apparatus. The admixture may have been previously exposed to a magnetic separator for the purpose of isolating out the ferrous constituents thereof. We will assume, for the purposes of illustration only, that such is the case. However, it is clear that the present invention could be used for gross separation by weight, including the ferrous metals, and that such metals might be removed subsequently to passage thereof through the present apparatus.

Figure 2:
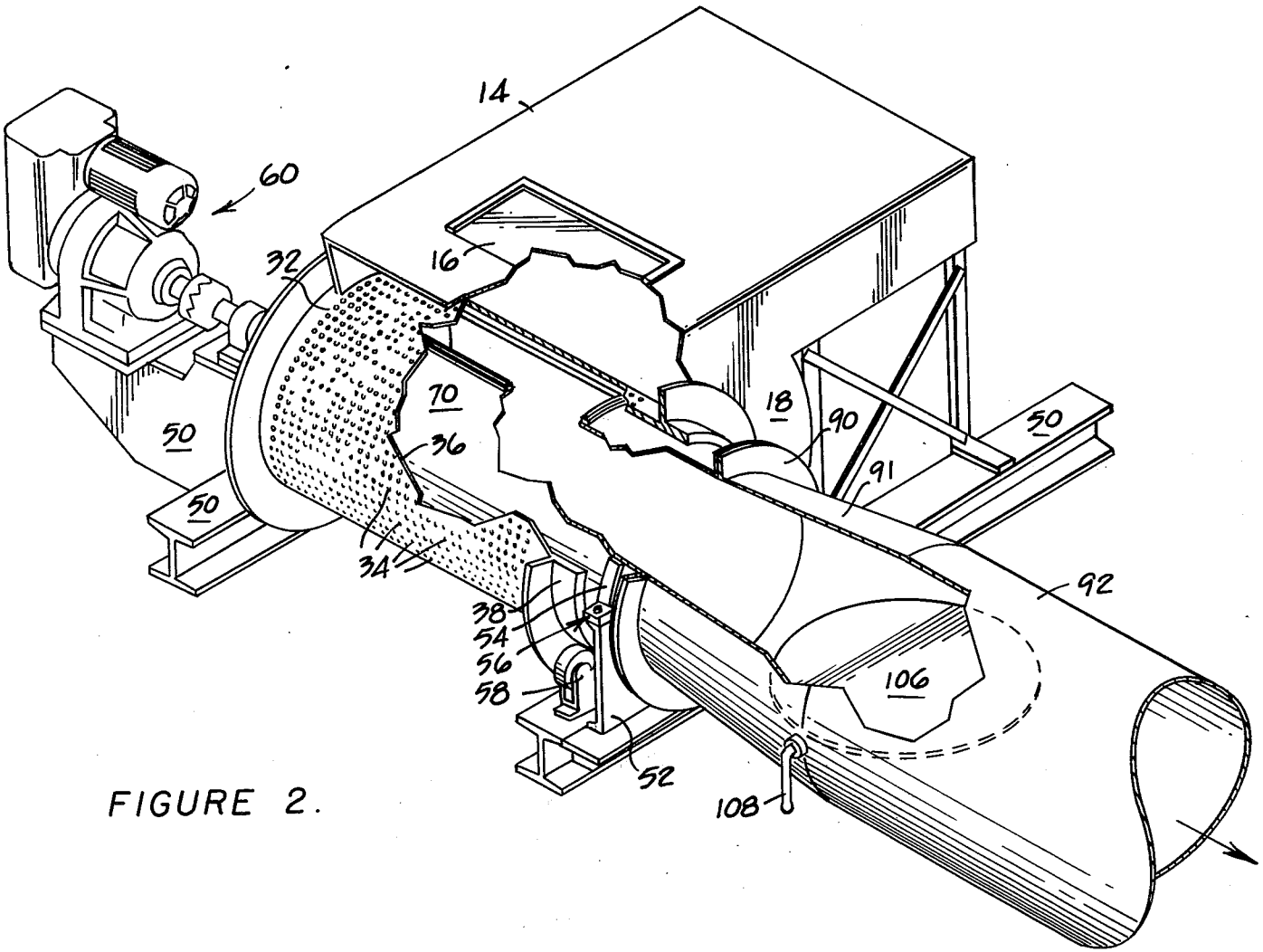
FIG. 2 is an enlarged partially sectioned isometric view of the rotating drum and suction portions of the apparatus.
Figures 3, 4:
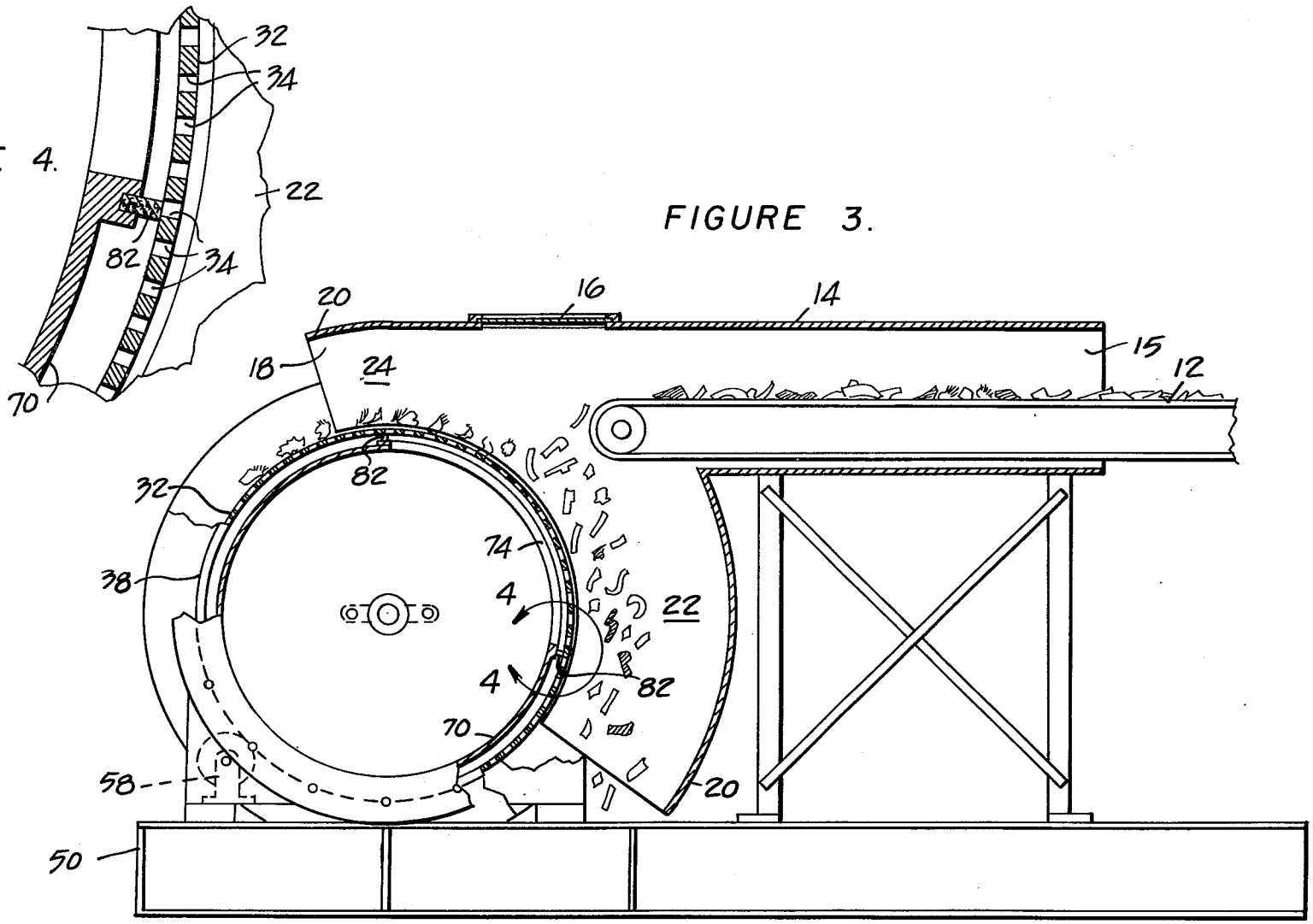
FIG. 3 is a section view of the rotating drum and feed shroud apparatus.
FIG. 4 is a magnified view of a portion of drum periphery shown by the circling arrows in FIG. 3.

From the conveyor belt 12, the admixture proceeds in the direction of the arrows of FIG. 1 to an entranceway 15 of shroud means 14 for separation. The shroud means, seen in greater detail in FIGS. 2 and 3, is equipped with an inspection window 16 of suitable design to enable facile monitoring of the operation. The shroud means comprise a partially cylindrical shell having flat endwalls 18 and curvilinear peripheral walls 20 for substantially sealingly containing the admixture issuing from the conveyor belt 12. The entire admixture conveyed by belt 12 is dumped, within the shroud, proximate the periphery of a rotating drum 32, as shown in FIGS. 1 and 3. As will be explained more fully hereinafter, the drum, rotating in the direction of the arrows shown in FIG. 3, attracts certain relatively lighter components of the admixture to its surface and carries them in a counterclockwise direction about the axis of rotation of the drum. The heaviest components of the admixture, such as die cast aluminum, brass, and copper, do not adhere to the drum but instead drop directly through a first exit portion 22 of the shroud. With reference to FIG. 1, it may be noted that these heaviest components of the admixture drop onto a short second conveying means, comprising a belt 19 for transmission to a selected point. The lightest components of the admixture adhere to and are carried by the peripheral surface of the rotating drum to a point beyond a second exit portion 24 of the shroud means where such components drop off the surface of the drum and onto a third conveying means, including belt 17 for conveyance to another selected point of deposition.

Figure 5:
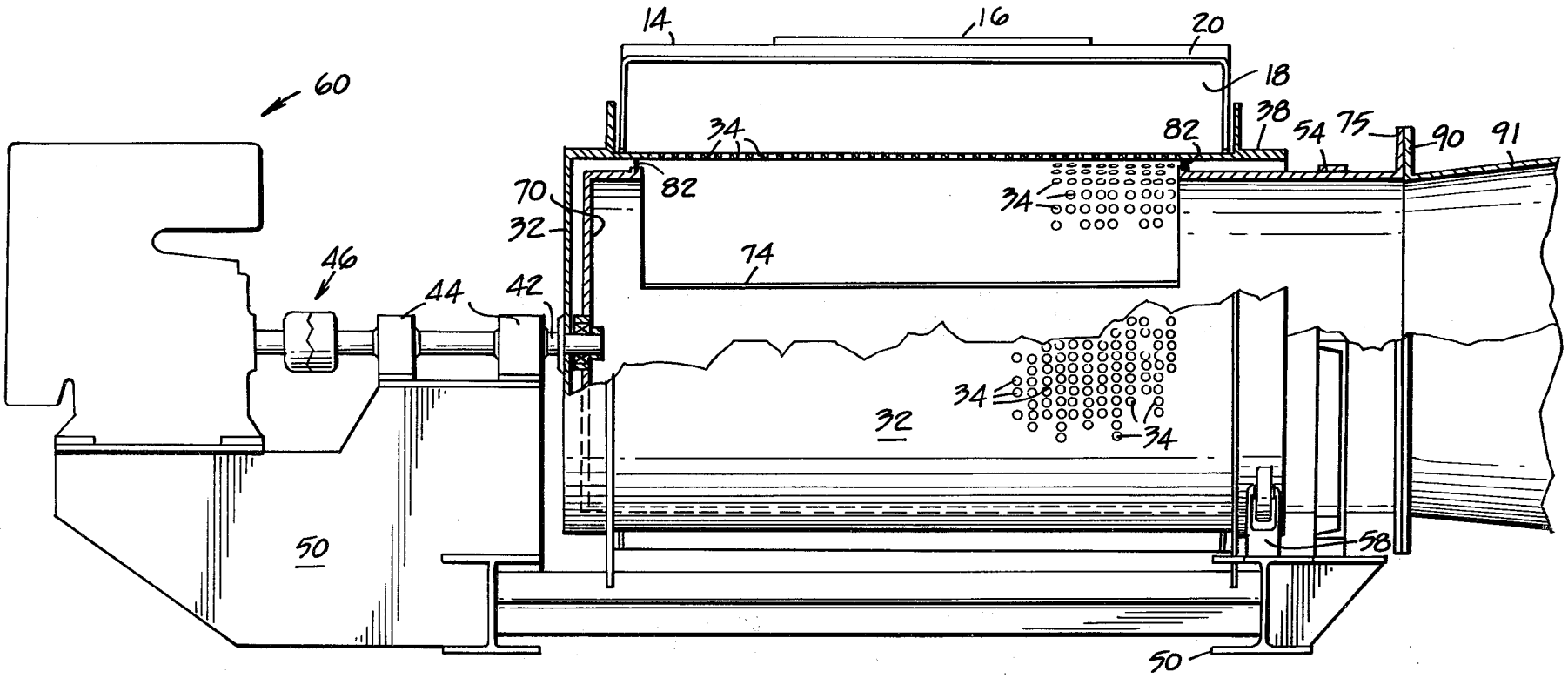
FIG. 5 is an enlarged partially sectioned frontal elevation of the drum and feeder section of the apparatus.

The details of the rotating drum and its associated structure will now be explained. Drum 32 is substantially completely covered with transpiercing perforations 34 which communicate the exterior of the drum with the hollow interior 36 thereof. The drum 32 is mounted for rotation upon an axle 42 (see FIG. 5). The axle 42 is journaled in support bearings 44 which are in turn attached to supporting framework means 50 by a suitable expedient, such as bolts or welding. The axle is suitably connected by means of clutch or disconnect coupling means 46 to drive motor means 60, which motor means could be driven electrically or by a turbine actuated by system exhaust gases. In a typical installation the drive motor would be a 3 h.p., three phase, 480 volt, 60 cycle, system with a speed variable between 14 and 114 r.p.m. The motor may be individually controlled or coordinated with other system parameters as will be explained more fully hereinafter.

It may be noted that the axle 42, in addition to supporting the rotating drum 32, also provides support for interior drum or pressure communication means 70. The drum means 70 are journaled upon bearings 72 which surround the axle 42 so that the drum 70 is fixed relative to the drum 32 and the axle. Inner drum means 70 are imperforate except for a large substantially rectangular communication port 74 which communicates the interior of the drum with the exterior thereof internally of the rotating drum 32, as shown clearly in FIGS. 3 and 5.

Suitable seal means 82 are provided on the inner drum 70 about the boundaries of the communication port 74 to assure that pressure conditions extant within the hollow interior of drum 70 are communicated only to those of the perforations 34 which are passing over the port means 74 at any given time.

As previously described, one end of the inner drum 70 is supportably mounted on the bearings 72. The opposite end of the drum 70 is supported by the framework means 50 by means of an upstanding saddle member 52 which cradles the outer periphery of the inner drum. The inner drum is held fixedly in place within the saddle at a given angular orientation by means of a circumscribing strap 54 which is bolted at 56 to the saddle member 52. It may be readily noted that, upon release of the bolts 56 and loosening of the strap means 54, the inner drum may be angularly displaced to selectively change the area of communication between the interior of the drum 70 and the perforations of the circumscribing rotating drum 32. As will be explained more fully hereinafter, this provision enables one to vary the point of application of fluid pressure to the admixture of shredded materials issuing from the conveyor belt 12 onto the rotating drum 32.

Adjacent to the upstanding saddle means 52 are a plurality of upstanding support rollers 58 which supportively act upon an outer peripheral portion 38 of the drum 32.

The inner drum 70 terminates at one end thereof in a flange 76. The flange 76 abuts another flange 90 of a fluid communicating conduit means 92. It will be noted that the conduit means is provided with a necked-down throat portion 91 immediately adjacent the point of connection to the flange of the inner drum 70. The flanges 90 and 76 may suitable connected by means of welding or by releasable couplings such as bolts, etc.

As its distal end the conduit 92 is provided with an upstanding flange 94, which flange is suitably connected to an adjacent flange 100 at the inlet of a high volume vacuum fan or blower means 102. Typically, the blower could be a 75 h.p. centrifugal impeller type having a capacity of 30,000 c.f.m. The fan is equipped at 104 with suitable exhaust means for conveying exhaust gases to a point of convenient disposal of previously described use such as a turbine for driving other components of the apparatus, or the like. The precise turbine structure, i.e., turbine wheel and connection linkage, is notoriously well known, and is not part, in and of itself, of the present invention. To provide control of the pressure conditions extant within the hollow interior of the fixed drum 70, a suitable damper or choke valve 106 is provided in the conduit means 92. Suitable linkage means 108 are provided for positioning the valve means 106 either manually or automatically in coordination with other control functions of the system.

OPERATION

With reference to the accompanying drawings, the operation of the instant apparatus in its various processing modes will now be described.

Shredded materials are carried by the conveyor belt 12 to the inlet portion 15 of the shroud 14. As shown in FIG. 3, such shredded materials drop off the end of the conveyor belt onto the rotating peripheral surface of the drum 32. Such materials are immediately drawn to the perforations 34 which are adjacent to the open port means 74 of the inner drum 70 by virtue of the high vacuum condition therewithin. As previously stated, by loosening the strap means 54, the drum 70 can be rotated within its saddle support 52 with consequent angular displacement of the port 74 to vary the point of application of pressure to the shredded materials.

The heaviest materials issuing from the belt 12 do not adhere to the rotating drum 32 but instead fall immediately through a first exit portion 20 of the shroud to suitable conveying belt means 16. The relatively lighter components of the admixture, however, will adhere to the perforations 34 and will be carried, in a counterclockwise direction, as shown in FIG. 3, by the drum 32 to a point beyond the sealing edge 82 of the communication port 74. In the usual operation, the sealing point 82 shown in FIG. 3 will be positioned so that a tangent drawn through it will lie in a substantially horizontal plane. The will cause materials carried beyond such sealing point and, consequently remote from the influence of the vacuum source, to be carried by gravity for some angular distance in the rotation of the drum 32 to a point at which said constituents fall from the drum onto the collection belt 17. It will be apparent that, by varying the angular position of the port means 74, the speed of the drum 32, and the fluid pressure extant in the drum 70, the drum 32 can be made to pick up more or less of the constituents of the shredded admixture at any given angular point and at any rate.

The process just described may be repeated any number of times by repassing the segregated constituents from the belt 16 any number of times or by passage of such materials to additional units connected in series such as is shown in phantom in FIG. 1.

It is contemplated that the components of the instant apparatus will be fabricated from readily available materials such as sheet metal for the conduits and shroud, stainless steel for the drums, cast steel for the framework, and impregnated fiber or teflon for the seals.

Thus, the preferred embodiments of the invention have been illustrated and described. It must be understood that these preferred embodiments are capable of variation and modification and are not limited to the precise details set forth. For example, instead of a pressure communicating port 74 of fixed dimensions, a variable size, valve type communicating means could be provided so that the angular duration of material exposure to the negative pressure source could be varied. It should also be noted that the instant apparatus, while primarily intended as an auto scrap processing machine, also has general utility and may be used for separating any shredded materials. This invention includes all such variations and modifications as fall within the scope of the appended claims.

I claim:

1. A multi-component apparatus for separating the constituents of an admixture of materials comprising, in series: conveying means for conveying said materials from a source thereof to a first point of deposition, material separation means disposed proximate said first point of deposition for receiving said material from said conveying means and for separating out constituents of said admixture in accordance with the relative weights thereof, said separation means including means for directly mechanically contacting said admixture and adhering to a constituent of said admixture, said separation means further including a source of fluid under pressure and means for communicating said source of fluid under pressure to said means for contacting said admixture, said means for contacting said admixture being movable relative to said means for communicating said source of fluid pressure, said fluid pressure functioning in coordination with said movable contacting means to cause at least some of said constituents to adhere to said movable means and to be carried thereby from a first position proximate to said conveying means to a second position relatively remote from said first position, said movable contacting means including a perforate drum having a first axial length and being rotatable about a first axis, said fluid pressure being communicated to a hollow interior portion of said perforate rotatable drum, said pressure communicating means further including a relatively fixed drum coaxially disposed with respect to said rotatable drum, said relatively fixed drum having a cylindrical surface extending 360° about its axis, said relatively fixed drum having a second axial length, the outermost confines of said relatively fixed drum closely proximate to said perforate rotatable drum, said relatively fixed drum including passageway means extending axially along said cylindrical surface for transmitting fluid pressure to said interior of said rotatable perforate drum, said passageway means extending axially along said cylindrical surface a distance less than said second axial length, said seal means between said passageway means and said perforate rotatable drum.

2. The invention of claim 1 wherein said means for communicating said fluid pressure include control means for selectively varying the pressure communicated to said movable contacting means.

3. The invention of claim 2 wherein said control means include at least one valve member disposed between said source of fluid pressure said movable contacting means.

4. The invention of claim 1 including means for selectively modifying the angular orientation of said passageway means to provide a selective area of exposure of the perforations of said perforate rotatable drum to said fluid under pressure.

5. The invention of claim 1 wherein said rotatable drum is mounted for rotation upon and with an axle and said axle is supportively journaled within first bearing means mounted upon frame means, said fixed drum being supportively journaled about second bearing means upon said axle.

6. Apparatus for separating constituents of an admixture of materials comprising; a source of mixed material constituents, material constituent separation means, means for conveying said admixed constituents to said separation means, means for conveying constituents from said separation means, said separation means including a source of fluid pressure, said separation means further including means for directly physically contacting some of said constituents, means for communicating said contacting means with said source of pressure, said pressure causing at least some of said constituents to adhere to said contacting means for separation from such other of said constituents as do not so adhere to said contacting means, said contacting means including a rotatable hollow drum, said rotatable drum having passage means for transmitting said pressure between the hollow interior and the exterior of said rotatable drum, said pressure communicating means including a relatively fixed drum member having an axially extending curvalinear surface extending 360° about the axis of said drum member closely proximate said rotatable hollow drum, said curvalinear surface having a passageway therethrough for transmitting said pressure from said source of fluid pressure to said passage means, said passageway extending axially a distance less than the axial length of said relatively fixed drum member, control means for controlling the fluid pressure communicated to said passage means, seal means between said passageway and said rotatable hollow drum.

7. The invention of claim 6 wherein said conveying means comprise a first conveyor device for carrying admixed constituents to said contacting means and at least a second conveyor device for carrying at least one separated constituent from said contacting means.

8. The invention of claim 7 wherein said separation means further include shroud means, said shroud means including an inlet portion proximate said first conveyor device, a further portion at least partially enclosing said contacting means, and a plurality of outlet portions at least one of which is disposed proximate said second conveyor device.

9. The invention of claim 6 wherein said rotatable drum is rotatable about an axle, said fixed drum member being disposed coaxially with said rotatable drum and being at least partially supported by said axle.

10. The invention of claim 9 wherein motor means are provided for driving said axle and said rotatable drum, selectively engageable coupling means connectably disposed between said motor means and said axle.

11. The invention of claim 9 wherein frame means are provided for supporting said apparatus, said fixed drum member and said rotatable drum each having spaced apart opposite end portions, said axle being supportively rotatably mounted upon said frame means, said axle supporting one said end portion of each of said fixed drum member and rotatable drum, roller means mounted upon said frame means, said roller means rotatably supporting said end portion of said rotatable drum which is opposite to said end portion supported by said axle.

12. The invention of claim 6 wherein said source of fluid pressure includes fluid pump means, conduit means between said pump means and said fixed drum member, said control means being disposed within said conduit means between said pump means and said fixed drum member.

13. The invention of claim 12 wherein said pump means is a centrifugal air blower and wherein said fluid pressure transmitted to said passage means is less than ambient pressure.

14. Apparatus for separating constituents of an admixture of materials comprising; a source of mixed material constituents, material constituent separation means, means for conveying said admixed constituents to said separation means, means for conveying constituents from said separation means, said separation means including a source of fluid pressure, said separation means further including means for directly physically contacting some of said constituents, means for communicating said contacting means with said source of pressure, said pressure causing at least some of said constituents to adhere to said contacting means for separation from such other of said constituents as do not so adhere to said contacting means, said contacting means including a rotatable hollow drum, said rotatable drum having passage means for transmitting said pressure between the hollow interior and the exterior of said rotatable drum, said pressure communicating means including a relatively fixed drum member closely proximate said rotatable hollow drum and having a passageway therethrough for transmitting said pressure from said source of fluid pressure to said passage means, control means for controlling the fluid pressure communicated to said passage means, seal means between said passageway and said rotatable hollow drum, said rotatable drum being rotatable about an axle, said fixed drum member being disposed coaxially with said rotatable drum and being at least partially supported by said axle, frame means for supporting said apparatus, said fixed drum member and said rotatable drum each having spaced apart opposite end portions, said axle being supportively rotatably mounted upon said frame means, said axle supporting one said end portion of each of said fixed drum member and rotatable drum, roller means mounted upon said frame means, said roller means rotatably supporting said end portion of said rotatable drum which is opposite to said end portion supported by said axle, saddle means mounted upon said frame means for supportingly engaging said end portion of said fixed drum member opposite to said end portion supported by said axle, said saddle means permitting angular movement of said relatively fixed drum member about the axis thereof concurrently with providing support therefor.

15. The invention of claim 14 wherein said means in said fixed drum member for transmitting pressure comprises a passageway in said fixed drum member and wherein the angular orientation of said passageway may be selectively changed by angular movement of said fixed drum member with respect to said saddle means for selectively altering the place of pressure application to said passage means of said rotatable drum.

16. The invention of claim 15 wherein said passageway has discrete boundaries, seal means for said boundaries for substantially sealingly preventing the application of said fluid pressure to said passage means except when said passage means are immediately proximate said passageway.

17. The invention of claim 16 wherein said boundaries are selectively adjustable to regulate the dimensions of said passageway.

18. The invention of claim 15 wherein said fixed drum member is disposed within a hollow interior portion of said rotatable drum, and wherein said passage means include a plurality of individual perforations, such that fluid pressure produced at said source of fluid pressure is transmitted from said fixed drum member, through said passageway to the interior of said rotatable drum and to only those of said perforations as are disposed immediately proximate to and within the boundaries of said passageway.

19. The invention of claim 14 further including clamping means for selectively clamping and fixing said fixed drum member in a given angular orientation with respect to said saddle means.

* * * * *